US009802741B2

(12) United States Patent
Phelan

(10) Patent No.: US 9,802,741 B2
(45) Date of Patent: Oct. 31, 2017

(54) CONTAINER WITH PADLOCK MOUNT

(71) Applicant: Becklin Holdings, Inc., Grants Pass, OR (US)

(72) Inventor: Matthew Phelan, Central Point, OR (US)

(73) Assignee: Becklin Holdings, Inc., Grants Pass, OR (US)

( * ) Notice: Subject to any disclaimer, the term of this patent is extended or adjusted under 35 U.S.C. 154(b) by 337 days.

(21) Appl. No.: 14/566,511

(22) Filed: Dec. 10, 2014

(65) Prior Publication Data

US 2016/0168880 A1 Jun. 16, 2016

(51) Int. Cl.

| | |
|---|---|
| ***A45C 13/10*** | (2006.01) |
| ***B65D 55/14*** | (2006.01) |
| ***B65D 21/02*** | (2006.01) |
| *E05B 67/38* | (2006.01) |

(52) U.S. Cl.

CPC ..... *B65D 55/14* (2013.01); *B65D 21/0223* (2013.01); *E05B 67/383* (2013.01)

(58) Field of Classification Search

CPC .... B65D 21/0223; B65D 55/14; B65D 55/02; E05B 67/383; E05B 73/0005

USPC .... 206/349, 372, 373, 508, 509, 1.5, 3, 317; 70/20, 63, 69, 77, 79, 164, 203; 109/52; 220/4.21, 4.22

See application file for complete search history.

(56) References Cited

U.S. PATENT DOCUMENTS

| | | | |
|---|---|---|---|
| 879,455 | A | 2/1908 | Frost |
| 2,695,115 | A | 11/1954 | Roop |
| 2,849,151 | A | 8/1958 | Heil |
| 2,939,603 | A | 6/1960 | Young |
| 3,103,278 | A | 9/1963 | Kuzma et al. |
| 3,117,692 | A | 1/1964 | Carpenter et al. |
| 3,383,009 | A | 5/1968 | Weikert |
| 3,391,824 | A | 7/1968 | Wiseman |
| 3,407,758 | A | 10/1968 | Simkins |
| 3,419,184 | A | 12/1968 | Asenbauer |
| 3,481,502 | A | 12/1969 | Slayman |
| 3,616,943 | A | 11/1971 | Brink |
| 3,754,645 | A | 8/1973 | Kilroy |
| 3,756,396 | A | 9/1973 | Kilroy |
| 3,759,416 | A | 9/1973 | Constantine |
| 3,811,747 | A | 5/1974 | Levin |
| D236,326 | S | 8/1975 | Trebilcock |

(Continued)

FOREIGN PATENT DOCUMENTS

| | | |
|---|---|---|
| EP | 0129860 | 1/1985 |
| JP | 05254542 | 10/1993 |
| WO | 2012/009035 | 1/2012 |

OTHER PUBLICATIONS

Sano et al. Machine Translation of JP 5-254542A "Container". Oct. 5, 1993, Paragraph 30 Lines 2-4.

*Primary Examiner* — Luan K Bui

(74) *Attorney, Agent, or Firm* — Lowe Graham Jones PLLC

(57) ABSTRACT

An improved mount for receiving a padlock to securely enclose a case includes a pair of aligned holes and aligned indentations formed in the lid and the container body. The padlock mount includes a saddle formed between one of the holes and indentations, with a peripheral sidewall to restrict rotational movement of a padlock shackle. A padlock receptacle receives the padlock body in a recessed area to protect it against damage and restrict movement.

13 Claims, 5 Drawing Sheets

(56) References Cited

U.S. PATENT DOCUMENTS 3,916,803 A 11/1975 Garcia
3,926,321 A 12/1975 Trebilcock
3,968,879 A 7/1976 Lucas, Sr. et al.
4,000,704 A 1/1977 Griffin, Jr.
4,287,997 A 9/1981 Rolfe et al.
4,550,525 A * 11/1985 Baker ..... A01M 25/004 43/131
4,618,059 A 10/1986 Cochran
4,655,360 A 4/1987 Juhanson
4,671,411 A 6/1987 Rehrig et al.
4,712,657 A * 12/1987 Myers ..... A45C 5/00 190/28
4,765,252 A 8/1988 Shuert
4,832,200 A 5/1989 Deaton et al.
4,848,605 A 7/1989 Wise
4,883,251 A 11/1989 Manas
4,889,235 A 12/1989 Hess
5,042,674 A * 8/1991 Ramsay ..... B65D 21/0219 206/505
5,054,617 A 10/1991 Young et al.
5,167,336 A 12/1992 Lajovic
D333,094 S 2/1993 Zutler
5,203,494 A 4/1993 Blomfield
5,272,832 A * 12/1993 Marshall ..... A01M 25/004 220/326
5,332,114 A 7/1994 Sano et al.
5,341,926 A * 8/1994 Leben ..... G11B 23/023 206/307
5,350,150 A * 9/1994 Fiore ..... A45C 13/18 248/305
5,392,945 A 2/1995 Syrek
5,404,829 A 4/1995 Shuert
D361,715 S 8/1995 Haupert
5,454,477 A 10/1995 Bornhorst et al.
5,507,389 A 4/1996 Syrek
5,566,824 A 10/1996 Tack et al.
5,641,090 A 6/1997 Kowalski et al.
5,718,350 A 2/1998 Williams
5,769,230 A 6/1998 Koefelda
5,779,051 A 7/1998 Boutin
5,890,595 A 4/1999 Credle, Jr.
5,974,981 A 11/1999 Ditton
6,021,916 A 2/2000 Stolzman
6,085,467 A 7/2000 Packrall et al.
6,186,345 B1 2/2001 Robertson
6,237,758 B1 5/2001 Hsu
D446,017 S 8/2001 Koefelda
6,308,858 B1 10/2001 Koefelda
6,367,630 B1 4/2002 Elskamp
6,371,364 B1 4/2002 Maillot et al.
6,446,563 B1 9/2002 Ohanesian
6,457,599 B1 10/2002 Apps et al.
6,585,090 B2 7/2003 Harvey
6,604,390 B1 * 8/2003 Nooner ..... B65D 55/14 109/50
6,622,642 B2 9/2003 Ohanesian
6,662,950 B1 12/2003 Cleaver
6,698,362 B2 3/2004 Crevillen Pastor
D500,924 S 1/2005 Martin et al.
7,163,122 B2 1/2007 Elder et al.
7,252,196 B1 8/2007 Koefelda et al.
7,537,119 B2 5/2009 Becklin
7,740,138 B2 6/2010 Becklin
8,016,966 B2 9/2011 Becklin
2004/0134390 A1 7/2004 Apps et al.
2004/0178208 A1 9/2004 Leba et al.
2005/0199459 A1 9/2005 Harvey
2006/0107707 A1 * 5/2006 Vaughn ..... E05B 67/383 70/18
2006/0254946 A1 11/2006 Becklin
2006/0254947 A1 11/2006 Rogers
2008/0017650 A1 1/2008 Evans et al.
2008/0264820 A1 10/2008 Becklin
2009/0178946 A1 7/2009 Patstone et al.
2010/0102055 A1 4/2010 Becklin
2010/0108556 A1 * 5/2010 Claffy ..... B65D 11/24 206/508
2010/0219193 A1 9/2010 Becklin
2012/0006837 A1 1/2012 Becklin

* cited by examiner

CONTAINER WITH PADLOCK MOUNT

FIELD OF THE INVENTION

This invention relates to a container having a mount for a padlock, preferably incorporated into a stackable container and configured to accommodate padlocks of a variety of sizes.

BACKGROUND OF THE INVENTION

Various types of containers are used to receive and support delicate cargo such as electronic, computer, optical and other types of equipment. Example containers for such purposes may take the form of transit containers, rack-mount containers, tote containers or others. In some instances, containers of this type are used in military and commercial environments in which handling by persons or equipment may subject the containers to external forces from a variety of directions. Likewise, because the cargo may be valuable it is often useful to incorporate a lock or a means for locking the container. In some cases, containers of this type are designed to be stackable, and thus they may include stacking elements or features arranged in a desired pattern in order to restrict lateral movement of containers stacked atop other containers.

Security for such containers can be an essential attribute and, in order to allow the containers to be locked for restricted access, a lock of some form is often provided on the container in order to lock the lid of the container securely atop the lower container body. In some instances, the lock is formed as a part of the container clasp system, with an integrated key-lock that requires use of a key to unlock the clasps in order to open the lid. In other instances (or together with locking clasps), a separate removable padlock may be attached at a location that will hold the lid firmly against the lower container body, preventing the lid from being opened without first removing the padlock. For example, the lid and lower container may each have laterally-extending flanges that abut one another when the lid is in the closed position, with one or more aligned holes being formed in each of the mating lid and container flanges. The shackle of the padlock can then be passed through the aligned holes in the lid and container flanges so that the shackle can then be inserted into the padlock case to lock the lid against the container.

Current containers that provide a location for mounting a padlock do so in a way in which the padlock itself is exposed to abuse and is able to move through a large range of motion, allowing for potential damage to the lock and the portion of the case where the lock is attached. Depending on the severity of an external force applied to the case in the vicinity of the lock, the configuration of current structures may cause catastrophic damage to the lock or the case, thereby compromising the security of the case.

SUMMARY OF THE INVENTION

The present invention provides for an improved mount for receiving a padlock to securely enclose a case. In accordance with preferred versions of a case having a padlock mount, the mount incorporates features that restrict the movement of the padlock and protect the padlock against damage by external forces acting against the case.

In one version of the invention, the padlock mount is formed to incorporate a saddle adjacent one or more holes configured to receive a shackle of a padlock. Preferably, the saddle is formed to define a surface corresponding to an inner surface of the shackle.

In some versions of the invention, the container external sidewall is formed with a cavity configured to receive the padlock and protect the padlock against damage caused by external forces. The cavity is further defined by sidewalls that may restrict the padlock against rotational movement, thereby limiting damage caused to the padlock and to the padlock mount.

In a further example of the invention, a single pair of mating holes is provided in the lid and upper container for receiving the shackle, and preferably the shackle toe can be passed through the single pair of mating holes. At the opposite end of the saddle, an indentation is formed in the rim of the lid and the base for receiving the shackle heel. Most preferably, the top of the saddle is bounded by opposing sidewalls or ridges that restrict the top of the shackle against rotational movement when the padlock is in place.

Optionally, the padlock mount is incorporated into a container having features for enabling multiple containers to be stacked atop one another. In one example, the stackable version of the containers may include a plurality projections and cavities formed on complementary surfaces of two or more containers. The projections and cavities are positioned in complementary locations such that the projections will be received within the cavities when the containers are stacked, thereby restricting lateral movement of an upper container stacked atop a lower container.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

Figure 1:
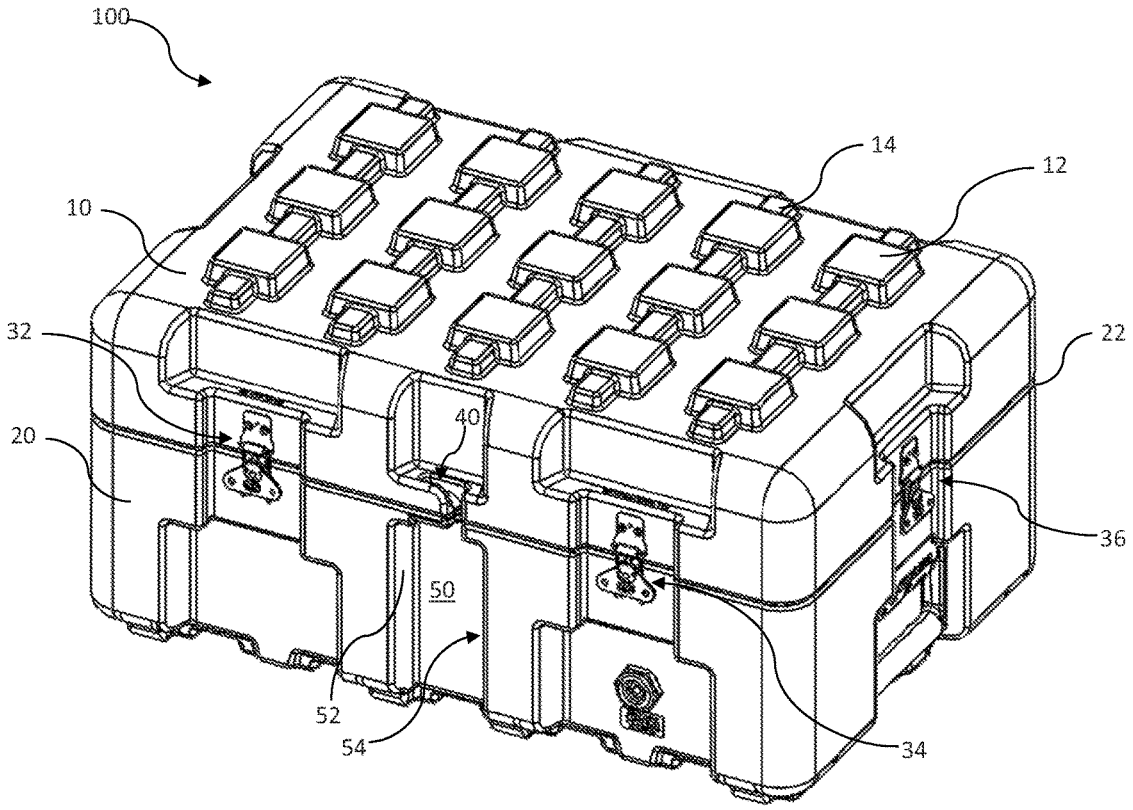
FIG. 1 is a top perspective view of a preferred container having a preferred padlock mount.

FIG. 1 illustrates a preferred container 100 having a lid 10 and a lower container body 20. In the illustrated example, the lid is attached to the lower container body along an interface 22 shown as a seam between the lid and the container body. Thus, in the illustrated example the lid and container body terminate at an interface defining a seam 22 that lies in a common horizontal plane. Each of the lid 10 and the container body 20 may define an interior space 60 (see FIG. 4, for example) for receiving and retaining articles to be stored and contained within the container. In the illustrated example the container body 20 is deeper than the lid 10, and therefore defines a larger interior volume in the container body than the interior volume of the lid. In other examples, each of the container body and the lid may be deeper or shallower than the illustrated version.

The lid is mountable to the container body to define an enclosed space for the container when the lid is mounted to the container body in a closed position (as illustrated in FIG.

1). In alternate versions of the invention, the lid may be fully separable from the container body, or it may be pivotally attached (for example, through the use of hinges) to enable the lid to pivot through open and closed positions. One or more clasps, for example, 32, 34, 36 may also be provided to retain the lid in a closed position tightly against the container body. In some versions the clasps may hold the lid against the container body, while in other versions the clasps may also incorporate a lockable feature that requires a key or other tool to unlock the clasp.

The container may optionally include one or more features to facilitate stacking of multiple containers. For example, as show in the illustrated version, the lid may include a plurality of recessed or raised features 12, 14 that interact with complementary recessed or raised features (not shown) formed on an outer surface of another container body. When two or more containers are stacked, the raised or recessed features abut one another to hinder lateral movement of the stacked containers with respect to one another.

The recessed or raised features to aid in stacking are preferably incorporated through either direct molding of the substrate material forming the case or by molding a secondary material (e.g. aluminum or steel) in the desired shape and then bonding or otherwise attaching or adhering the features to the substrate material.

The preferred container further includes a padlock mount having features for protecting a padlock and limiting movement of the padlock. Most preferably, the padlock mount extends across the seam 22 between the lid and the container body. In the illustrated example, the padlock mount includes a saddle 40 configured to receive a shackle of the padlock. Most preferably, the saddle 40 is incorporated into the lid 10, as shown. The padlock mount further includes a receptacle 50 for receiving a body of the padlock, and as illustrated the preferred receptacle is bounded by a pair of opposing sidewalls 52, 54. The padlock receptacle is preferably formed in the container body. In various examples of the invention, the container is divided into a first container portion and a second container portion that are separable from one another, with the saddle being incorporated into the first portion of the container and the receptacle being incorporated into the second container portion. As such, the padlock mount extends across the first and second container portions.

Figure 2:
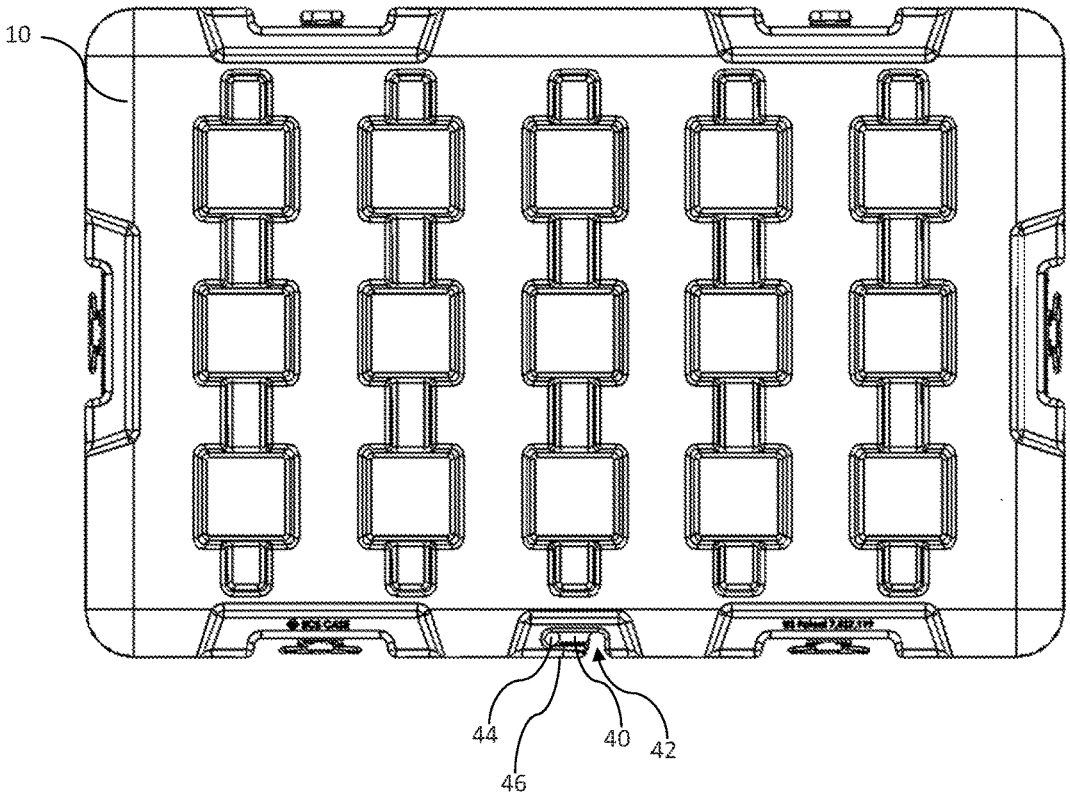
FIG. 2 is a top view of the container of FIG. 1.
Figure 3:
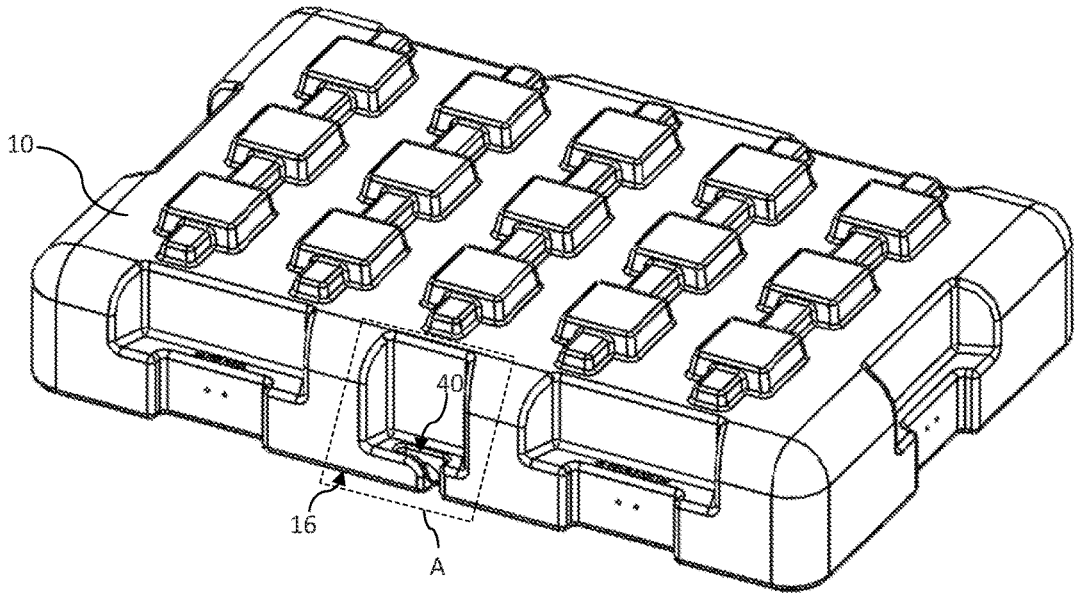
FIG. 3 is a top perspective view of the lid of the container of FIG. 1, shown separated from the lower container body.
Figure 4:
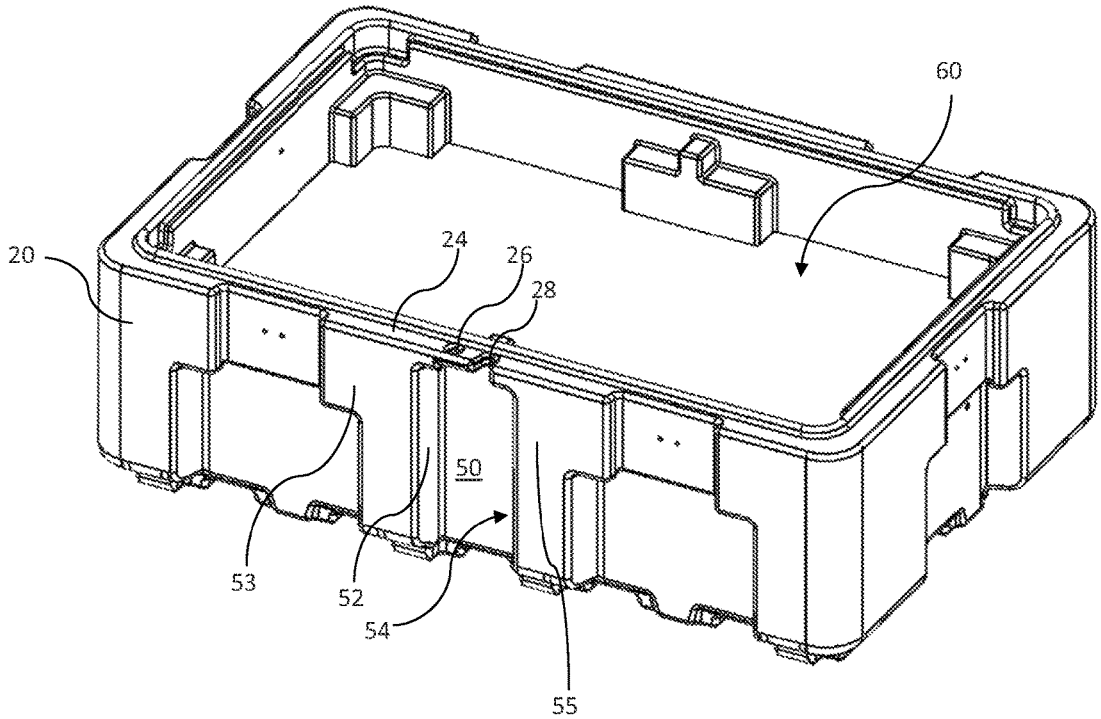
FIG. 4 is a top perspective view of the lower container body of FIG. 1, shown separated from the lid.
Figure 5:
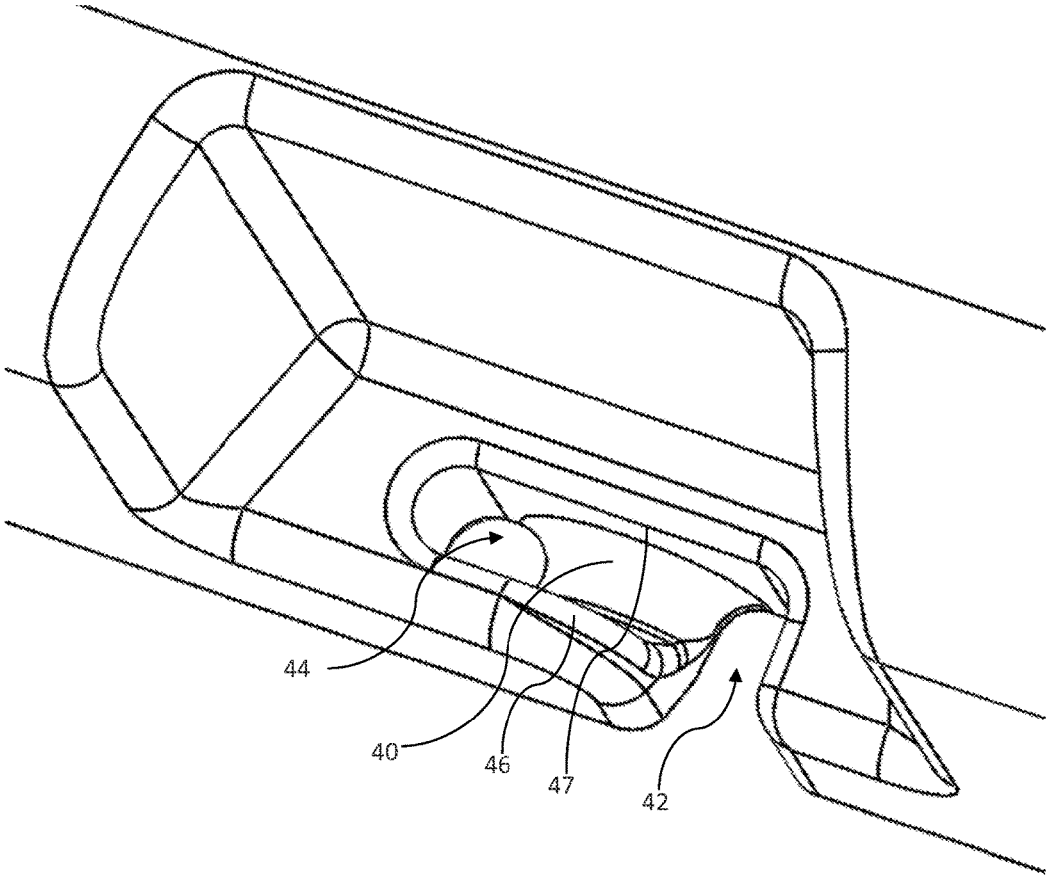
FIG. 5 is a close-up view of detail A of FIG. 3, showing an enlarged view of a saddle portion of a preferred padlock mount incorporated into a lid.

As best seen in FIGS. 2, 3, and 5, in a preferred version of the invention the saddle 40 is incorporated into the lid of the container and is positioned adjacent a lower surface or rim 16 (see FIG. 3) of the lid 10, which abuts a mating upper surface or rim 24 (see FIG. 4) of the container body when the lid is closed against the container body. As noted above, most preferably, the upper and lower surfaces 16, 24 each terminate along a common plane, thereby defining a planar interface along the seam 22. In some versions, the upper and lower surfaces in the vicinity of the padlock mount may be formed as lateral flanges that abut or are otherwise adjacent one another.

At one side of the saddle 40, a hole 44 is provided along a peripheral edge of the lid, slightly inward from a portion of a sidewall of the lid. The hole 44 extends through the edge of the lid, and is configured to enable the toe of a padlock shackle to extend through the hole 44. At an opposite side of the saddle 44, a channel or indentation 42 is formed. The indentation extends from a peripheral surface of a sidewall of the lid in a direction inward toward an interior of the lid. The indentation is configured to receive the heel of the padlock shackle so that the shackle can be attached to the lid inwardly from the outermost vertical surfaces of the lid sidewall in versions in which the lid is defined by a top and downwardly extending sidewalls. The saddle is formed to follow a generally raised, arcuate path between the indentation 42 and the hole 44, to provide further support for the shackle and to reduce stress on the area surrounding the hole 44 and indentation 42. The raised nature of the saddle forms an upper surface of the saddle which is raised to a highest point (in a direction toward the top of the lid) at a location centrally between the hole 44 and the indentation 42, curving downward from the central location toward both the hole 44 and the indentation 42.

The saddle 40 is further bounded by an outer peripheral sidewall 46 and an inner sidewall 47. The inner and outer sidewalls 46, 47 are raised above the saddle 40 (that is in a direction away from the lower surface 16 of the lid and toward the top of the lid). Most preferably, the inner and outer sidewalls 46, 47 are substantially linear between the hole 44 and indentation 42. Accordingly, the combination of inner and outer sidewalls serves to impede rotational movement of the padlock and shackle when the padlock is in place, joining the lid to the container body.

The lower container body 20 is further illustrated in FIG. 4, shown with a lid detached. As shown, the lower container body includes a floor and upwardly extending sidewalls to define an interior space. The preferred version of the lower container body 20 includes a laterally extending ledge 24, which may be formed as a peripheral flange or a seat on an upper rim of the container body, for example. The ledge is configured to abut at least a portion of the lower edge 16 of the lid 10 when the lid is closed against the container body. In the illustrated example, the ledge 24 may be atop raised support columns 53, 55 which extend laterally outward from adjacent portions of the sidewall of the container body 20, and which have a width along a portion of the circumference of the container body 20 such that the support columns are wider than a mere flange or fin.

The container body 20 includes a second hole 26, in which the second hole 26 is sized and positioned to be aligned with the first hole 44 formed in the lid 10 when the lid is in a closed position atop the container body 20. As with the lid, the container body includes an indentation 28 formed in the ledge 24. The indentation 28 of the container body is configured to be aligned with the indentation 42 of the lid when the lid is in position to enclose the container body, thereby allowing a portion of the shackle to extend through both the lid indentation 42 and the container indentation 28.

Beneath the ledge 24, a padlock receptacle 50 is provided. The padlock receptacle 50 is defined by a pair of opposing sidewalls 52, 54 formed on an outer surface of the container body below the ledge. In the illustrated example, the vertical sidewalls 52, 54 are formed along adjacent support columns 53, 55. The receptacle 50 is sized and shaped to receive a padlock between the sidewalls, and is preferably formed with a depth (toward the interior of the container body) such that the padlock is recessed to form a cavity in a direction toward the interior of the container body. Most preferably, the sidewalls 52, 54 provide a depth to the receptacle 50 such that the padlock is retained fully within the area defined by the lateral outermost surfaces of the opposing sidewalls. In this fashion, the padlock will be protected within the receptacle against external forces that may be imparted by foreign objects.

In use, the lid 10 is positioned atop the container body 20 such that the rim of the lid abuts the rim of the container body. As described above, the holes in the lid and the container body are aligned with one another when the lid is closed atop the container body, and likewise the indentations in the lid and container body are aligned. A padlock is opened and unlocked so that the heel end of the shackle can be pushed into the aligned indentations and the toe end of the shackle positioned above the aligned holes. The toe end of the shackle is then pushed downward through the aligned holes and into the padlock body, which is positioned in the padlock receptacle 50. Accordingly, the padlock locks the lid against the container body. In addition, the shackle is supported by the saddle formed in the lid.

In some versions of the invention, the saddle as described above may be incorporated in to the container body rather than the lid. In one such example, the orientation of the features of the padlock mount may be essentially inverted in order to attach a padlock to the container with the shackle beneath the padlock body. Likewise, in some instances the containers may be invertible, with no true lid or container body. Thus, in general the saddle and padlock receptacle portions may be equally incorporated into either of a first portion of a container and a second portion of a container that combine to form an enclosed space, with either the first portion or the second portion serving as the lid and the other serving as the container body.

In some versions of the invention, the saddle and receptacle features may be rotated to a position other than a substantially orthogonal orientation with respect to the plane of the rims of the lid and container body as shown in the illustrated examples. Thus, for example, the saddle may be rotated in a particular example to an angle such as 30 degrees or 45 degrees with respect to a vertical axis extending centrally from a bottom of the container to a top of the container.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A container, comprising:

a first container portion and a second container portion, the first container portion and the second container portion being selectively positionable apart from one another or against one another to enclose an interior space and defining an interface between the first container portion and the second container portion when the first container portion is positioned against the second container portion; and a padlock mount positioned on the container and extending across the interface between the first container portion and the second container portion, the padlock mount further having:

a first hole and a first indentation provided in the first container portion; and a second hole and a second indentation provided in the second container portion, the first hole being aligned with the second hole and the first indentation being aligned with the second indentation when the first container portion is positioned against the second container portion to enclose the interior space, whereby a shackle of a padlock is receivable within the aligned holes and the aligned indentations to lock the first container portion to the second container portion; and a saddle on the first container portion between the first hole and the first indentation, wherein the saddle further comprises a pair of opposing sidewalls raised above the saddle and extending between the first indentation and the first hole.

2. The container of claim 1, wherein first indentation extends from an outer surface of the first container portion toward the interior of the first container portion, and further wherein the second indentation extends from an outer surface of the second container portion toward the interior of the second container portion.

3. The container of claim 1, further comprising a padlock receptacle provided on an outer surface of the second container portion adjacent the second indentation and the second hole, the padlock receptacle being configured as a cavity extending inward toward the interior space of the cavity.

4. The container of claim 3, wherein the padlock receptacle further comprises a pair of opposing sidewalls extending laterally outward from the second container portion, the opposing sidewalls defining a depth of the padlock receptacle.

5. The container of claim 1, wherein the first container portion comprises a lower rim, the saddle being positioned adjacent the lower rim.

6. The container of claim 1, wherein first container portion comprises a lid and the second container portion comprises a container body.

7. A container comprising:

a container body having a floor and a plurality of upwardly extending sidewalls terminating in a container body rim and defining an interior space;

a lid having a top and a lid rim, the lid rim being positionable against the container body rim to enclose the interior space; and a padlock mount positioned on the container and extending across the lid rim and the container body rim, the padlock mount further having:

a first hole and a first indentation located on the lid adjacent the lid rim;

a second hole and a second indentation located on the container body adjacent the container body rim, the first hole being aligned with the second hole and the first indentation being aligned with the second indentation when the lid is positioned against the container body to enclose the interior space; and a saddle located on the lid between the first hole and the first indentation, the saddle defining a raised path between the first hole and the first indentation.

8. The container of claim 7, wherein first indentation extends from an outer surface of the lid toward an interior of the lid, and further wherein the second indentation extends from an outer surface of the container body toward the interior of the container body.

9. The container of claim 8, wherein the saddle further comprises a peripheral sidewall raised above the saddle and extending between the first indentation and the first hole.

10. The container of claim 9, further comprising a padlock receptacle configured as a cavity on an outer surface of the container body sidewalls in a position adjacent the second indentation and the second hole.

11. The container of claim 10, wherein the padlock receptacle further comprises a pair of opposing receptacle sidewalls extending laterally outward from the container body sidewalls.

12. The container of claim 10, wherein the lid comprises a lower rim, the saddle being positioned adjacent the lower rim.

13. The container of claim 10, wherein the lid further comprises downward-extending lid sidewalls terminating in the lid rim, the lid top and sidewalls defining a lid interior space.

* * * * *